US005851234A

United States Patent [19]

Huneycutt

[11] Patent Number: 5,851,234

[45] Date of Patent: Dec. 22, 1998

[54] PROCESS FOR WET WASHING WOOL FABRIC

[75] Inventor: Ted Eugene Huneycutt, Norwood, N.C.

[73] Assignee: Elite Textiles, Ltd., Albemarle, N.C.

[21] Appl. No.: 816,485

[22] Filed: Mar. 13, 1997

[51] Int. Cl.[6] ..... D06L 1/12; D06L 1/16

[52] U.S. Cl. ..... 8/137; 8/158; 8/159

[58] Field of Search ..... 8/137, 158, 159; 510/283; 68/131, 132, 133, 134, 135, 136

[56] References Cited

U.S. PATENT DOCUMENTS

| | | | |
|---|---|---|---|
| 3,589,148 | 6/1971 | Wasemann | 68/12 |
| 3,660,909 | 5/1972 | Willcox | 34/533 |
| 4,750,907 | 6/1988 | Wilsberg | 8/137 |
| 5,232,611 | 8/1993 | Ohasi et al. | 252/8.6 |
| 5,384,060 | 1/1995 | Mandy et al. | 510/283 |
| 5,504,954 | 4/1996 | Joo et al. | 8/158 |
| 5,520,025 | 5/1996 | Joo et al. | 68/12.05 |

FOREIGN PATENT DOCUMENTS 279483 2/1988 European Pat. Off. .

OTHER PUBLICATIONS

Pellerin Milnor Corporation brochure, 55, 110 & 165 Suspended Washer–Extractors Model 42032 F7 J, 1996 (Month Unknown).

Pellerin Milnor Corporation brochure, Outerwear Wetcleaning Machine Model 30022 F8W, 1995 (Month Unknown).

*Primary Examiner*—Alan Diamond

*Attorney, Agent, or Firm*—Rhodes, Coats & Bennett, L.L.P.

[57] ABSTRACT

The present invention relates to a process for wet washing wool fabric and woolen articles. The process permits wet washing of articles such as aircraft seat covers while substantially eliminating shrinkage and preserving the fire retardant characteristics of the seat covers. The process includes washing the articles in an aqueous solution using a bi-directional intermittent wash cycle. The wash cycle includes agitating in a first direction for about two minutes, pausing agitation for about four minutes, agitating in a second opposite direction for about two minutes, and pausing agitation for four minutes. This wash cycle may be repeated up to three times. The articles are then tumbled dried to a moisture level of about 20 percent. The drying process is completed by static drying the articles without mechanical action until all remaining moisture in the articles is removed. The static drying step is conducted at a temperature between about 280 degrees F and about 300 degrees F.

12 Claims, 1 Drawing Sheet

PROCESS FOR WET WASHING WOOL FABRIC

BACKGROUND OF THE INVENTION

The present invention relates to a process for wet washing wool fabric. In particular, the invention relates to a process for wet washing wool fabric to substantially eliminate shrinkage.

Wool is a widely used, natural protein fiber having desirable characteristics of good absorbency and resiliency. The fiber is used for a variety of applications ranging from clothing to carpet. However, wool fibers have a scaly surface structure that creates dimensional stability problems with wool fabrics. The scales on the outer layer of the wool fiber tend to tangle and mat together when such fabric is washed. This characteristic has been referred to as felting shrinkage and is irreversible. Wool fiber can also experience relaxation shrinkage caused by mechanical action such as tumble drying which may or may not be reversible. In either case, the shrinkage is most severe when the wool fabric is water washed and then dried using conventional drying processes.

For these reasons just described, wool fabric typically is dry cleaned and is not wet washed. Washable wool fabrics have been developed by the application of shrink-resistant finishes. These finishes alter the scales of the wool fibers or, alternatively, coat the fiber structure to prevent scale interlocking. Silicone fiber treatment agents, such as that described in U.S. Pat. No. 5,232,611, have been used for the latter approach.

Wool is a desirable material for aircraft upholstery given its excellent inherent flame resistance characteristics. Government regulations specify rigid procedures for the application of flame-retardants to wool fabric to enhance its natural flame resistant character. Flame retardant performance is sensitive to the cleaning procedure and equipment used on the fabric. For instance, the flame-resistance of these materials is adversely effected by even trace amounts of silicone which is used to improve the qualities of wool fabric. Like most wool fabric articles, aircraft upholstery seat covers have been dry cleaned to avoid the shrinkage problems described above. However, the dry cleaning process is not without its problems. Occasionally severe shrinkage has occurred when excess water (more than about 1%) is present in the dry cleaning bath. Moreover, rising chemical costs and ever-stricter environmental regulations make dry cleaning increasingly expensive and not desirable.

Therefore, there is a need for a process for wet washing wool fabric while maintaining the fabric's dimensional stability, appearance and flame retardant characteristics.

SUMMARY OF THE INVENTION

The present invention relates to a process for wet washing wool so as to maintain the dimensional stability of the articles being washed. The process provides significant cost advantages over commonly used dry cleaning processes. The process may be used for all wool fabrics, but is particularly adapted for aircraft upholstery, as discussed herein.

The process comprises the steps of providing a dedicated washing machine for aircraft upholstery fabric, and wet washing the fabric in the dedicated washing machine in an aqueous solution using a bi-directional intermittent pause cycle. The fabric is then rinsed using an acidic rinse so as not to degrade the performance of fire retardants applied to the aircraft upholstery. The acidic rinse could be an acetic acid solution having a concentration of between about 0.20% and 0.30%. The upholstery may then be dried on a semi-flexible frame in the absence of agitation.

The drying step could also comprise a two-step process of first tumble drying the articles to a moisture level of less than about 80%. The articles could also be tumble dried to a moisture level ranging between about 20% to about 15% moisture. The second step is a static drying step which removes all remaining moisture from the articles. Static drying, as used herein, refers to drying that takes place without mechanical action being imparted to the articles being dried. It has been found that if the fabric is not agitated as the moisture remaining at the end of tumble dry step is removed, then no shrinkage occurs.

If the articles to be cleaned are heavily soiled, sorting or prespotting may be appropriate. Prespotting is also desirable to remove those stains which could degrade the performance of fire retardants or could cause flammable conditions during drying.

These and other aspects of the present invention will be become apparent to those skilled in the art after a reading of the following description of the preferred embodiments when considered in conjunction with the drawings.

DESCRIPTION OF THE PREFERRED EMBODIMENT

Figure 1:
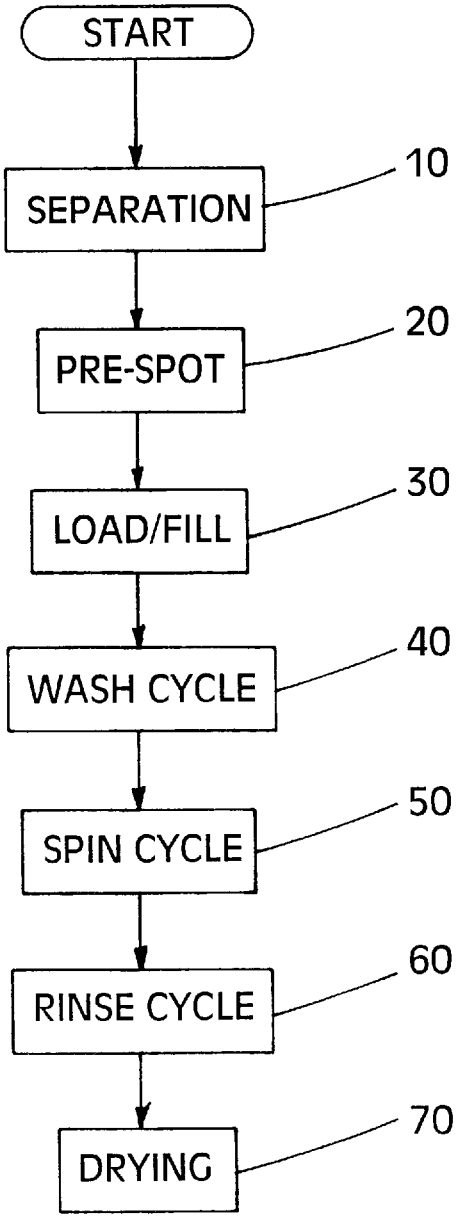
FIG. 1 is a schematic representation of the process of the present invention.

Referring now to FIG. 1, it should be understood that the illustration is for the purpose of describing a preferred embodiment of the invention and is not intended to limit the invention thereto. FIG. 1 illustrates a schematic representation of the process of the present invention. The first step 10 is to separate the articles to be cleaned based on a need to prespot localized heavy soiling. Preferably the separation step will generate three categories of items. The first category is aircraft wool articles with normal soiling. The second category is aircraft wool items requiring prespotting. The separation of aircraft upholstery items is important given the problems with adversely effecting flame retardant performance as discussed above. The practice of the present invention contemplates the provision of dedicated laundry machines for aircraft upholstery to ensure that trace amounts of contaminants are not present in the wash liquor. The third category of articles is comprised of all other wool articles. The need for separation will depend on the presence of both aircraft upholstery articles and other types of articles at the beginning of the process.

In the prespot step 20, articles with heavy soiling are treated with a prespotting solution which may be a solvent/detergent or a water/detergent mixture. As used herein, the terms soil and soiling refer to dirt and stains of all types. Suitable prespotting solutions are well known in the art, and the selection of a particular prespotting solution is not a critical element of the practice of the present invention. Prespotting is not an essential step for the process but has the benefit of extending wash liquor life.

In load step 30, the wool articles are loaded into a washing machine preferably to no more than about ½ of the rated capacity for that machine. For example, a machine rated for 100 lbs. would be loaded with no more than about 50 lbs. of items. Although the present invention may be practiced with a load of more than ½ of rated machine capacity, using a smaller load decreases the mechanical action that occurs during the wash cycle. Also the smaller load creates a more favorable wash liquor ratio during agitation. The machine is next filled with cool water which is preferably at a temperature of 85° F. or less. In another preferred embodiment, the water temperature should not exceed 80° F.

The load 30 step also includes the addition of a suitable detergent for cleaning wool fabric. Suitable detergents will have low alkalinity, good low temperature cleaning capabilities and good organic chelating properties. The selection of a detergent is within the capability of one of ordinary skill in the art.

In the wash cycle 40, the items are wet washed in an aqueous wash liquor using a gentle cycle, again for the purpose of minimizing mechanical action on to the fabric. Preferably, the wash cycle is bi-directional with intermittent pause periods. A desirable cycle is illustrated in Table 1 below.

TABLE 1

| Action | Duration |
|---|---|
| Forward agitation | 2 minutes |
| Pause | 4 minutes |
| Reverse agitation | 2 minutes |
| Pause | 4 minutes |

The intermittent bi-directional wash cycle described in Table 1 can be repeated three times, in a preferred embodiment. It should be noted that the terms "Forward agitation" and "Reverse agitation" are used broadly to encompass agitation first in one direction and then in a second opposite direction. Moreover, for machines whose axis of agitation is vertical, the present invention may be practiced by intermittent use of gentle agitation.

While this wash cycle is believed to be desirable, variations in agitation time, pause time and number of cycles are contemplated in order to optimize performance. Modem commercial laundry machines feature computerized controls that permit creation of customized wash cycles. Thus, each of the parameters in Table 1 may be varied as needed from load to load. Suitable wet cleaning machines for the practice of the present invention include the Model 30022 F8W and the Model 42032 F7J manufactured by Pellerin Milnor. At the end of the wash cycle, the wash water is drained and the load is spun 50.

The rinse cycle 60 is a two-step rinse process. First the articles are rinsed using a spinning rinse with clean water Next, a final bath rinse is performed using clean slightly acidic water. In one embodiment for the final rinse, the machine is filled with water containing an acetic acid concentration of about 0.20% to about 0.30%. Preferably the concentration is about 0.25%. The load is gently agitated for two minutes. The acetic acid maintains the fabric at a slightly acidic pH so as not to adversely effect the performance of the flame-retardant in the wool fabric. Other acids may be used so long as their concentration is adjusted to produce a solution having a slightly acidic pH. Next, the rinse water is drained and the load is again spun to provide centrifugal removal of the rinse water.

Optionally, the load may next be extracted fully to remove all the water possible therefrom. In the laundry art, extraction refers to a very high speed spinning cycle that provides near complete water removal from a fabric load. Historically, extractors were separate machines so that a laundry load had to undergo extra handling to be extracted. Modern, high performance laundry machines, which are well known in the art, have the capability to both spin and extract fabric loads. The extraction process minimizes drying time and heat load requirements for drying.

The wool articles next proceed to drying step 70 where each article is placed on a semi-flexible frame to be held in an open position to permit air flow therethrough. For example, an aircraft seat cover would be placed on a wire frame having the approximate shape of the airline seat on which the cover is used. Clothing articles would be placed on supports which are similar to those used for commercial laundering. The practice of the present invention includes providing a semi-flexible frame which approximates the normal use shape of the article being cleaned. The term semi-flexible refers to having sufficient flexibility to allow an article to be pulled onto the frame but having sufficient rigidity thereafter to hold the article open so as to permit internal circulation during drying.

It should also be noted that some articles in their normal use are in a collapsed condition. An example is the pocket section of a three-piece aircraft seat cover. These kind of articles would be not be in their normal use position while carried on the frame. However, this situation falls within the scope of the present invention.

In one embodiment, the articles are suspended on a moving transport line for transport through a drying oven. Preferably, the oven is maintained at a temperature of less than about 300° F. In yet another embodiment, a temperature of less than about 280° F. is maintained in the oven. Lower temperatures are workable but will increase the required residence time in the oven to dry the articles completely. Article residence time in the oven will vary depending on a number of factors including product density, the use of a pre-drying step, and moisture content. Drying times can range from about 2 minutes to about 5 minutes. If predrying or extraction steps are not performed, drying times may be considerably longer. Ovens suitable for the practice of the present invention are well known in the art and the details pertaining thereto will not be repeated here. The particular drying oven used is not so important as is the need to ensure that the wool articles are substantially motionless as the last 10%–20% of the moisture therein is removed.

It should be understood that the moisture removal parameters contained herein refer to remaining the moisture that exceeds that moisture present in the fabric at standard conditions. For example, at standard conditions of temperature and humidity, wool fabric may have a moisture regain of about 13.6% to about 16%.

The need for motionless drying is most important only as the last of the moisture is being removed from the wool articles. It has been found that shrinkage observed in these articles occurs as the last portion of the moisture is removed. It follows that the present invention may be practiced using a tumble drying method to remove up to about 80% of the moisture from the articles. Thereafter, the drying process should be completed with the articles in a static condition. This drying completion could be accomplished with the articles in a tumble dryer that has been stopped and that is provided with a gentle flow of warm air to complete the process. Alternatively, the articles could be removed from the tumble dryer and placed on semi-flexible frames as described above to be air dried or to be oven dried. Still another alternative is the use of an infrared dryer to complete the drying process.

The process of the present invention provides advantages over conventional dry cleaning for clothing items and, in particular, for aircraft upholstery. First, wet washing avoids the need for expensive dry cleaning solvents which are subject to strict, costly environmental regulations. Moreover, health concerns have been raised in association with the sometimes high levels of dry cleaning solvents present in articles after the dry cleaning process. Next, on occasion, even the dry cleaning process will result in excessive shrinkage in wool items. The process of the present invention avoids that shrinkage by maintaining the items to be cleaned in a static, motionless condition as the last 10%–20% of the moisture therein is removed. Lastly, wet washing is a preferred method for removing certain kinds of soil such as perspiration, dirt and water-based stains.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalence.

What is claimed is:

1. A process for wet washing wool articles comprising:

a) washing the articles in an aqueous solution using a bi-directional intermittent agitation wash cycle;

b) tumble drying the articles to a moisture level of about 15% to about 20%; and c) static drying the articles without mechanical action until substantially all of the remaining moisture in the articles is removed.

2. The process of claim 1 further including prespotting the articles to remove soil that would degrade the performance of a fire retardant.

3. The process of claim 1 further comprising separating aircraft upholstery articles from non-aircraft upholstery articles.

4. The process of claim 3 wherein the washing step is conducted in a washing machine dedicated to aircraft upholstery.

5. The process of claim 1 wherein the bi-directional intermittent wash cycle comprises:

a) agitating in a first direction for about two minutes;

b) pausing agitation for about four minutes;

c) agitating in a second opposite direction for about two minutes; and d) pausing agitation for four minutes.

6. The process of claim 5 wherein the wash cycle is repeated three times.

7. The process of claim 1 wherein the static drying step is accomplished by air drying the articles in the absence of applied heat.

8. The process of claim 1 wherein the static drying step is accomplished using heated drying.

9. The process of claim 1 wherein the static drying step is conducted at a temperature of less than about 300° F.

10. The process of claim 1 wherein the static drying step is conducted at a temperature of between about 280° F. and about 300° F.

11. A process for wet washing wool articles comprising:

a) washing the articles in an aqueous solution using a bi-directional intermittent agitation wash cycle, the wash cycle comprising:

i) agitating in a first direction for about two minutes;

ii) pausing agitation for about four minutes;

iii) agitating in a second opposite direction for about two minutes; and iv) pausing agitation for four minutes;

b) tumble drying the articles to a moisture level of less than about 20%; and c) static drying the articles without mechanical action until all remaining moisture in the articles is removed, wherein the static drying step is accomplished at a temperature of less than about 300° F.

12. A process for wet washing wool articles comprising:

a) separating aircraft upholstery articles from non-aircraft upholstery articles;

b) prespotting the articles to remove soil that would degrade the performance of a fire retardant;

c) loading the articles into a dedicated washing machine in an amount about half of machine capacity;

d) washing the articles in an aqueous solution using a bi-directional intermittent agitation wash cycle, the wash cycle comprising:

i) agitating in a first direction for about two minutes;

ii) pausing agitation for about four minutes;

iii) agitating in a second opposite direction for about two minutes; and iv) pausing agitation for four minutes;

e) giving the articles a final rinse in a slightly acidic solution;

f) tumble drying the articles to a moisture level of less than about 20%; and g) static drying the articles without mechanical action until all remaining moisture in the articles is removed, wherein the static drying step is accomplished at a temperature of less than about 300° F.

* * * * *